United States Patent [19]

Saxon et al.

[11] 4,115,908

[45] Sep. 26, 1978

[54] APPARATUS FOR STUFFER BOX CRIMPING

[75] Inventors: Daniel Isaiah Saxon, Kingsport; Vernon Leon Leonard, Bristol, both of Tenn.

[73] Assignee: Eastman Kodak Company, Rochester, N.Y.

[21] Appl. No.: 875,468

[22] Filed: Feb. 6, 1978

[51] Int. Cl.[2] ..... D02G 1/12

[52] U.S. Cl. ..... 28/269

[58] Field of Search ..... 28/263, 268, 269, 270

[56] References Cited

U.S. PATENT DOCUMENTS

| | | | |
|---|---|---|---|
| 3,058,167 | 10/1962 | Rainard et al. | 28/269 X |
| 3,353,222 | 11/1967 | Keel et al. | 28/263 |
| 3,353,223 | 11/1967 | Coffin, Jr. et al. | 28/269 X |
| 3,553,802 | 1/1971 | Stanley | 28/268 |

*Primary Examiner*—Robert Mackey

*Attorney, Agent, or Firm*—Malcolm G. Dunn; Daniel B. Reece, III

[57] ABSTRACT

A flexible backing member is provided to bear in supporting relation against one side of a moveable ribbon sideplate in a stuffer box crimper to provide a smooth, elastic curved surfaced path for the ribbon sideplate to move thereagainst in all positions of its adjustment, with one end of the flexible backing member being connected in cantilevered manner at a location in or beyond the exit end of the crimping chamber.

3 Claims, 5 Drawing Figures

APPARATUS FOR STUFFER BOX CRIMPING

BACKGROUND OF THE INVENTION

The present invention is directed to a stuffer box crimping apparatus for crimping continuous filament tow for textile and industrial yarn purposes, and is particularly directed to an improved supporting arrangement for the moveable ribbon sideplates in the stuffer box crimping apparatus disclosed in U.S. Pat. No. 3,353,223, which issued Nov. 21, 1967.

Stuffer box crimping involves continuously feeding filament tow through the nip of a pair of coacting feedrolls into a crimping chamber, which may or may not be heated and which has some type of arrangement for adjusting the back pressure upon the tow in the crimping chamber, such as a clapper gate arrangement.

The tow is fed through the nip of the coacting feedrolls into the crimping chamber against the tow that is being held in the crimping chamber by the clapper gate arrangement. The incoming tow thus piles up against the chamber tow with the result that individual filaments become folded, convoluted and compressed. This continues until at some point in time, dependent upon feed rate, chamber geometry, and the extent of back pressure, crimped tow is forced out the discharge opening of the crimping chamber by other incoming tow.

The continuous filament tow may be made from any of the man-made fibers, such as from cellulose esters, polyesters, polyamides and the like. In the use of polyester, for instance, a white color may be imparted to the tow by use of a pigment such as titanium dioxide ($TiO_2$), which causes the tow to have an abrasive wearing effect on the crimping chamber, particularly with respect to the sideplates. The sideplates can become so worn as to cause poorly formed edges on the tow passing through the crimping chamber and even tearing and breaking of the filaments that come into contact with the worn sideplates. The above-mentioned U.S. Pat. No. 3,353,223 disclosed a solution for the problem of worn sideplates by providing a substantially uniform renewable surface against which tow to be crimped may bear as it passes through the crimping chamber. The disclosed renewable surface is in the form of a moveable ribbon sideplate, which may be made from a suitable material, such as brass, for instance, and which may be intermittently moved through the crimping chamber or moved continuously at a rate that will preclude undue wear of the ribbon sideplates by the abrasive tow. The ribbon sideplates, for instance, may be introduced from a supply roll located externally of the crimping chamber.

As shown in U.S. Pat. No. 3,353,223, each ribbon sideplate moves from a supply roll along the endfaces of the feedrolls and along one of the sidewalls of the crimping chamber. The ribbon sideplate is caused to bear closely against the endfaces of the feedrolls in sealing relation by a back-up pressure plate, which is adjustably loaded against the ribbon sideplate by adjusting screws and lock nuts mounted in a pressure plate holder. The ribbon sideplate serves to define one of the sidewalls of the crimping chamber and to prevent filaments of the tow from escaping past the ribbon sideplate at the feedroll endfaces. The top and bottom of the crimper chamber are formed by scraper blades, which nearly touch the surfaces, respectively, of the upper and lower feedrolls. The ribbon sideplate also forms a sealing relation with the upper and lower scraper blades to confine the tow within the crimping chamber.

One problem noted in the use of the ribbon sideplates concerns the effect of the adjustment of the ribbon sideplate against the endfaces of the feedrolls. Since the ribbon sideplate is relatively thin and flexible, it is forced by the pressure within the stuffing box chamber to conform to the shape of the surfaces which support it. A back-up pressure plate is located opposite the endfaces of the feedrolls on each end of the feedrolls, and a ribbon sideplate is interposed between the back-up pressure plate and the endfaces of the feedrolls and is adjustably urged against the feedroll endfaces by the back-up pressure plate. Where the ribbon sideplate extends past the feedroll endfaces and the back-up pressure plate and into the crimping chamber, an offset is created between the end of the back-up pressure plate and the adjacent sidewall. Because of the above-mentioned pressure within the stuffing box chamber, the ribbon sideplate conforms to this offset with the result that a kink is formed in its surface. Also, the endfaces of the feedrolls are gradually worn away during operation as they rub against the ribbon sideplates. Therefore, the back-up pressure plate has to be manually adjusted toward the feedrolls periodically so as to maintain the sealing relation. This results in a greater offset between the surface of the back-up pressure plate and the adjacent sidewall of the crimping chamber. When the ribbon sideplate is moved relative to the feedroll endfaces and sidewalls of the crimping chamber, the kink causes the ribbon sideplate to hang, sometimes causing the ribbon to be pulled apart, or causing a rough section of ribbon sideplate to be exposed to the tow. This produces a ragged edge on the crimped tow, and the operator anticipating this poor effect moves the ribbon sideplate more than would otherwise be required in order to remove the kinked ribbon sideplate from contact with the tow or the feedrolls, thus wasting expensive ribbon sideplates. Also, a ragged edge is produced on the tow while the kink is being moved between the back-up pressure plate and the roll feedroll endfaces.

Attempts have been made to alleviate the problem by making ribbon sideplates of increasing greater thicknesses, but this only makes the ribbon sideplate more expensive to manufacture without actually eliminating the potential for the ribbon sideplate to become kinked as the feedroll endfaces became more worn over a period of operating time. Also, attempts were made to change pressure back-up plate design, but this also did not serve to solve the problem.

SUMMARY OF THE INVENTION

An object of the invention, therefore, is to eliminate altogether the potential of the ribbon sideplate to kink, irrespective of any offsets and wear of the feedroll endfaces and the continued need to re-adjust the ribbon sideplates against the feedroll endfaces to maintain proper sealing relation therewith.

This object is carried out in the particular described environment of the stuffer box crimping apparatus shown in the above-mentioned U.S. Pat. No. 3,353,222 by providing an improved supporting arrangement for the ribbon sideplate.

More specifically, the object of the invention is carried out by providing a pair of flexible backing members for the disclosed pair of ribbon sideplates, each backing member flexibly bearing in supporting relation against one side of one of the ribbon sideplates along its length from the disclosed coacting feedrolls and into the crimping chamber. The flexible backing member provides a smooth, elastic curved surfaced path for the ribbon sideplate to move against in all positions of its adjustment, and irrespective of any offsets between any pressure back-up member and an adjacent sidewall. One end of each backing member is connected in cantilevered manner at a location that may be in, or beyond the exit end of the crimping chamber so that the backing member, as connected, forms a flexible support for the ribbon sideplate. The backing member is not only flexible along its length but is also flexible to a certain extent rotatively around the axis of its length so as to assure close conformance of the ribbon sideplate in sealing relation.

DESCRIPTION OF THE PREFERRED EMBODIMENT

Figure 1:
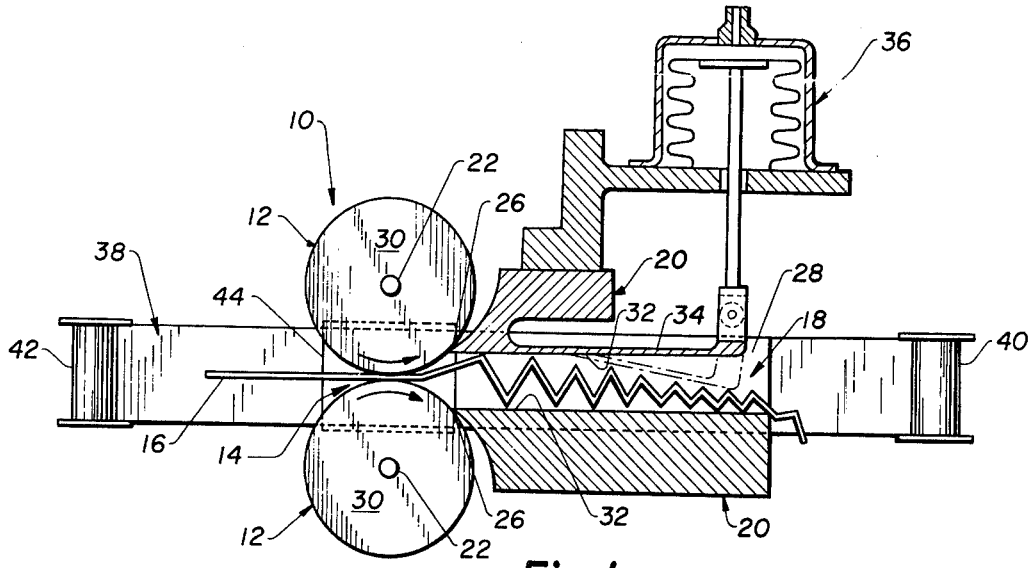
Fig. 1 PRIOR ART
FIG. 1 is a cross-sectional elevation view of a stuffer box crimper from the prior art, illustrating one construction of the type of crimper for which the invention disclosed herein is an improvement.

In reference to the drawings, the illustration in FIG. 1 is essentially the same as the illustration in FIG. 1 of U.S. Pat. No. 3,353,222 except for the addition of a ribbon sideplate, which is disclosed in more detail in U.S. Pat. No. 3,353,223. Thus, FIG. 1 shows one type of a stuffer box crimping apparatus 10 of the prior art in which the invention may be used. The apparatus has a pair of coacting feedrolls 12 spaced closely together so as to form a nip 14 therebetween through which moving continuous filament tow 16 is fed into a stuffer box crimping chamber 18. A pair of scraper blades 20 extend from the feedrolls in a longitudinal direction and are generally parallel to and at right angles to the axes 22 of the coacting feedrolls 12. The scraper blades form two opposed sides of the crimping chamber 18. Each scraper blade 20 has a blade edge 26 positioned so that it nearly touches one of the feedroll surfaces. It is essential that the blade edges do not actually touch the feedroll surfaces so that the feedroll surfaces will not be galled by the blade edges or otherwise damaged. The near-touching position of the scraper blades serves to minimize the possibility of any fiber becoming adhered to the feedroll surfaces and escaping from the crimping chamber before the exit end of the chamber.

A pair of sidewalls 28 (only one sidewall is shown in FIG. 1) extend along the length of the stuffer box crimping chamber 18 and also along and adjacent in parallel relation to the endfaces 30 of the coacting feedrolls 12, and also along and in parallel relation to the side edges 32 of the scraper blades 20.

A clapper gate or door is usually provided at the exit end of the crimping chamber of a stuffer box apparatus and serves to adjustably restrict the passage of fibers from the crimping chamber. The clapper gate thus provides one form of arrangement by which the back pressure may be adjusted in the crimping chamber. The design of a clapper gate is quite varied in the industry, and in one form it may be hinged to one of the scraper blades, and in the form illustrated in FIG. 1, the clapper gate 34 is shown as being integral with one of the scraper blades 20, thus forming a hingeless clapper gate. The adjustment of the clapper gate may be accomplished by use of the illustrated pneumatic actuactor 36, which serves to depress and release the clapper gate in order to obtain the desired degree of crimp uniformity in the continuous filament tow.

A pair of moveable ribbon sideplates 38 (only one ribbon sideplate is shown in FIG. 1), as first disclosed in the aforementioned U.S. Pat. No. 3,353,223, is positioned so that each ribbon sideplate bridges the nip 14 of the coacting feedrolls 12 along their endfaces 30 in parallel and sealing relation. The ribbon sideplates also extend into the crimping chamber 18 along the sidewalls 28 of the crimping chamber to form a sealing relation with the pair of scraper blades 20 and to define another pair of opposed sides of the crimping chamber. The scraper blades and ribbon sideplates thereby form the walls or sides of the crimping chamber within which the continuous filament tow is crimped.

The ribbon side plates 38 may be each introduced from a separate supply reel 40 located either upstream or downstream of the crimping apparatus, depending upon the desired direction of movement through the crimping chamber, and may be taken up by a separate take-up reel 42 located at the other end of the crimping apparatus from the supply reel. The reels may be suitably driven in rotation to move the ribbon sideplates either intermittently or continuously through the crimping chamber 18.

The continuous filament tow thus moves through the crimping chamber in such manner so that its edges are in contact with a ribbon sideplate, which as it is moved presents a renewed surface.

Figure 2:
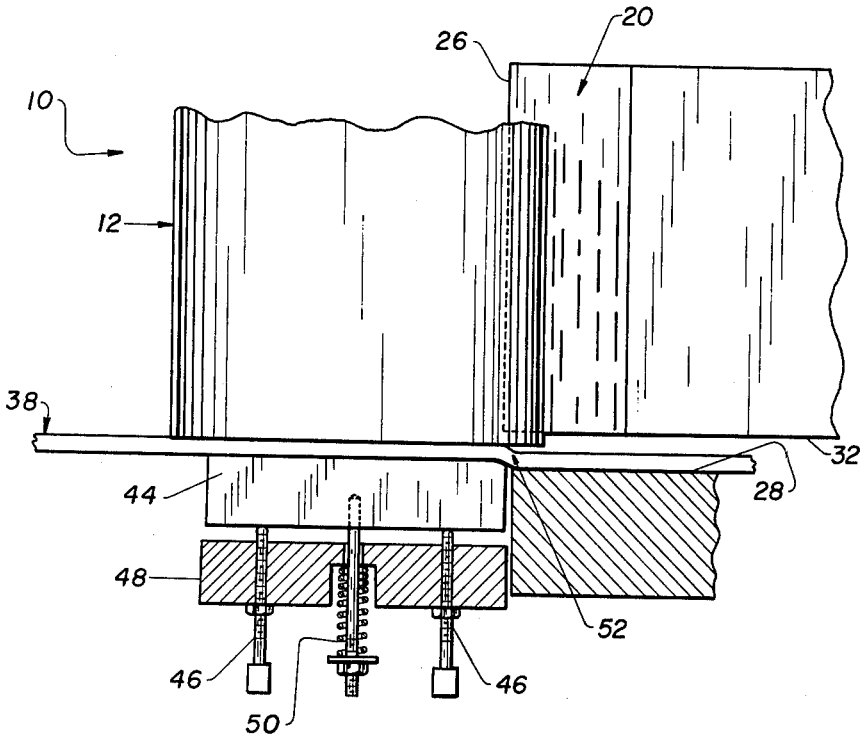
Fig. 2 PRIOR ART
FIG. 2 is a plan view of a portion of the prior art stuffer box crimper shown in FIG. 1, partly broken away and illustrating in exaggerated form one of the moving ribbon sideplates with a kink formed therein due to the resulting offset between the illustrated pressure back-up plate and the illustrated adjacent sidewall.

In reference to FIG. 2, the ribbon sideplates 38 are caused to bear closely in sealing relation to the endfaces 30 of the feedrolls 12 by back-up pressure plates 44 (only one is illustrated in FIG. 2). Each back-up pressure plate bears against the outer surface of one of the ribbon sideplates 38 and is forced against the ribbon sideplate by adjusting screws 46 adjustably positioned in a pressure plate holder 48, which in turn is suitably connected to the frame of the stuffer box crimping apparatus 10. The spring arrangement shown at 50 is connected at one end to the back-up pressure plate to cause movement of the back-up pressure plate in a direction away from the ribbon sideplate when the adjusting screws are so adjusted.

FIG. 2 illustrates in exaggerated detail a problem that has been noted in connection with the use of ribbon sideplates. The thickness of the ribbon is exaggerated so as to better illustrate the kink 52 which is formed at the offset between the back-up pressure plate 44 and the adjacent sidewall 28. The pressure exerted on the tow within the crimping chamber causes the relatively thin ribbon sideplate to be forced outwardly in close conformation against whatever restricting surface may be present, which in this case is the sidewall 28.

Over a long period of operating time, the ribbon sideplate causes wear of the feedroll endfaces at the surface of engagement with the endfaces. To compensate for this wear, the operator must re-adjust the back-up pressure plate by moving it further inwardly. This further inward movement causes a greater offset to occur between the back-up pressure plate and the sidewall, thus causing a larger kink to be formed in the ribbon sideplate at the location of the offset.

As mentioned above, attempts to solve this problem included making the ribbon sideplate of thicker material so that it would be more resistant to forming a kink. This attempt, however, was not successful. Other attempts included trying different designs of back-up pressure plates.

Figure 3:
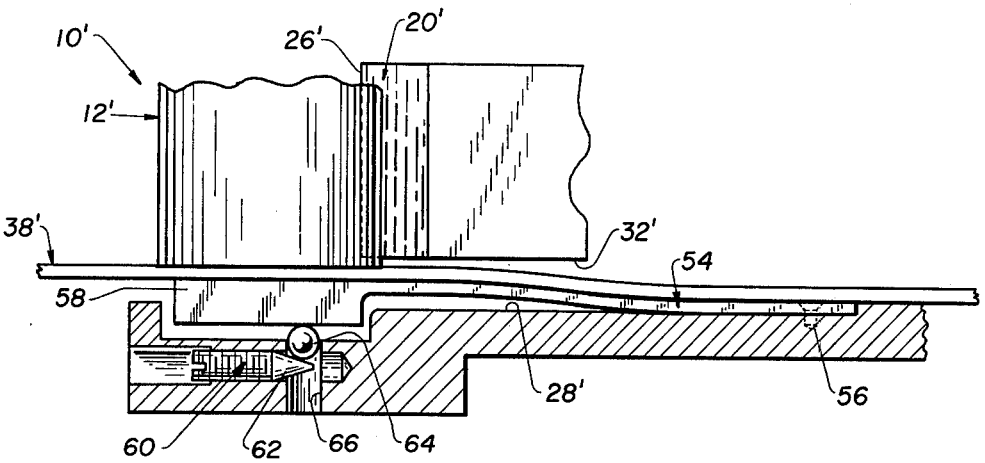
FIG. 3 is a plan view almost similar to FIG. 2 except for the illustrated flexible backing member of the herein disclosed invention and one type of adjustment for it in the form of a screw and ball arrangement.

FIG. 3, therefore, illustrates an effective solution to the problem.

In FIG. 3, the parts of the apparatus that are the same as illustrated and described in FIGS. 1 and 2 are identified by the same reference numbers, which are provided with prime marks after the reference numbers to show that FIG. 3 is a different embodiment from that shown in FIGS. 1 and 2. The parts, which have not been previously described, will be given different but unprimed reference numbers. In FIG. 3, a pair of flexible backing members 54 (only one backing member is shown) is provided for adjustably urging the ribbon sideplates into the aforedescribed sealing relation. Each backing member flexibly bears in supporting relation against one side of one of the ribbon sideplates 38' along its length and extends from the coacting feedrolls and into the crimping chamber 18. Each flexible backing member has one end 56 that is connected in cantilevered manner at a location that may be in the crimping chamber along the sidewall 28, as shown in FIG. 3, or may extend into and beyond the exit end of the crimping chamber for suitable cantilevered connection.

The other end of each flexible backing member has an enlarged pressure pad portion 58, which is adapted to be adjustably loaded against the ribbon sideplate for urging the ribbon sideplate in sealing relation against the feedroll endfaces. Any suitable means may be used to adjust the load, such as the screw and ball arrangement shown in FIG. 3. The threaded screw 60 has at one end a cone-like surface or wedge surface 62, which in turn bears against the ball 64 that is movably seated within a bore 66. As the threaded screw is threadingly advanced or retracted by the operator, the ball is caused to be moved correspondingly further inwardly against the pressure pad portion 58, or outwardly in relief of pressure against the pressure pad portion.

Figure 4:
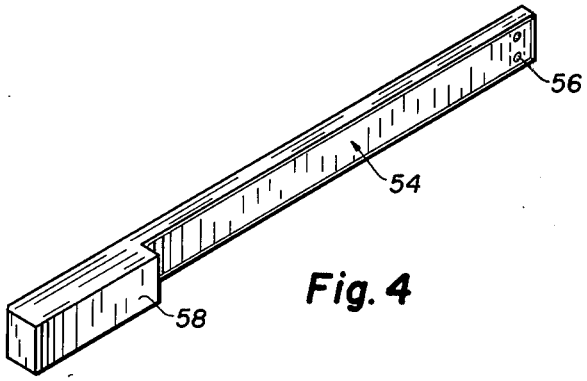
FIG. 4 is an isometric view of the flexible backing member.

As shown in FIG. 3 and also in FIG. 4, each flexible backing member is of such dimension in thickness and length, as well as being made from a suitable material, as to enable it to provide a smooth, elastic curved surfaced path for the ribbon sideplate to move thereagainst in all positions of adjustment of the ribbon sideplate. Thus, the flexible backing member prevents any kinks from forming in the ribbon sideplate where the location of the offset would have previously occurred. The flexible backing member is not only flexible along its length but is also flexible somewhat rotatively along the axis of its length so as to readily conform to any possible misalignment of the feedroll endfaces.

Figure 5:
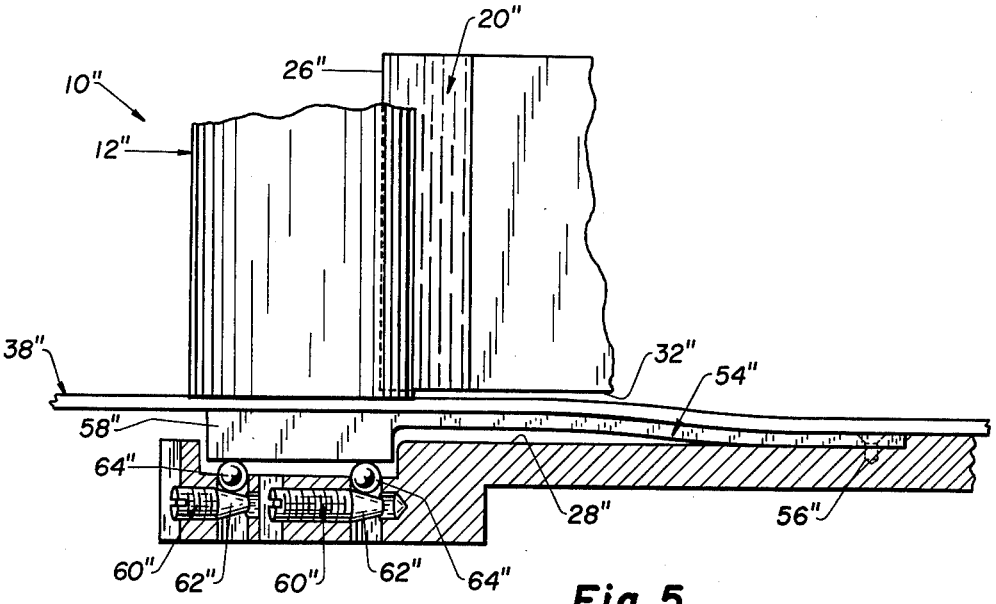
FIG. 5 is a plan view illustrating a portion of the plan view of FIG. 3 and illustrates an alternate embodiment for adjusting the flexible backing member, which alternate embodiment is in the form of a dual screw and dual ball arrangement.

FIG. 5 illustrates an alternative adjustment embodiment wherein two screws 60" and two balls 64" are provided to adjustably bear against the pressure pad portion of the flexible backing member. Like reference numbers identify like parts that were previously described, and are primed to show the different embodiment.

Obviously, the manner of adjusting the load may be accomplished by other suitable means as well as by the illustrated screw and ball arrangement.

The invention has been described in detail with particular reference to preferred embodiments thereof, but it will be understood that variations and modifications can be effected within the spirit and scope of the invention.

We claim:

1. In an apparatus for crimping continuous filament tow, said apparatus having a stuffer box crimping chamber;

a pair of coacting feedrolls spaced closely together so as to form therebetween a nip through which moving continuous filament tow is fed into the stuffer box crimping chamber;

a pair of scraper blades extending longitudinally generally parallel to and at right angles to the axes of the coacting feedrolls and forming two opposed sides of the crimping chamber, each scraper blade having a blade edge positioned so that it nearly touches one of the feedroll surfaces;

a pair of sidewalls, each sidewall extending along the length of the stuffer box crimping chamber and also along and adjacent the endfaces of the coacting feedrolls and the side edges of the pair of scraper blades;

a pair of moveable ribbon sideplates, each ribbon sideplate positioned so as to bridge the nip of the coacting feedrolls along their endfaces in sealing relation therewith and also to extend into the crimping chamber along one of the sidewalls to form a sealing relation with the pair of scraper blades to define one of the other opposed sides of the stuffer box crimping chamber;

means for moving said pair of ribbon sideplates relative to said feedroll endfaces, said sidewalls and said scraper blades; and means for adjustably urging the ribbon sideplates into said sealing relation;

the improvement wherein said means for adjustably urging the ribbon sideplates into said sealing relation comprises a pair of flexible backing members, each backing member flexibly bearing in supporting relation against one side of one of the ribbon sideplates along its length from the coacting feedrolls and into the crimping chamber and providing a smooth, elastic curved surfaced path for the ribbon sideplate to move thereagainst in all positions of its adjustment, one end of the flexible backing member being connected in cantilevered manner at a location beyond the exit end of, the the nip of the feedrolls.

2. In the apparatus as defined in claim 1, wherein each flexible backing member defines along its length at a location opposite the feedroll endfaces an enlarged pressure pad portion, which is adapted to be adjustably loaded against a ribbon sideplate for urging the ribbon sideplate in sealing relation against said feedroll endfaces, said improvement further including means for adjusting the load against said pressure pad portion.

3. In the apparatus as defined in claim 2, wherein said means for adjusting the load against said pressure pad portion comprises ball means adapted to bear against one side of said pressure pad portion, and wedge means adapted to engage said ball means, said wedge means being adjustable relative to said ball means so as to increase or decrease load of the engagement against said ball means for transmission of the load to said pressure pad portion.

* * * * *